US006528743B1

(12) United States Patent
Howie, Jr.

(10) Patent No.: US 6,528,743 B1
(45) Date of Patent: Mar. 4, 2003

(54) TIMER KNOB

(75) Inventor: Robert K. Howie, Jr., Decatur, IL (US)

(73) Assignee: The Grigoleit Company, Decatur, IL (US)

( * ) Notice: Subject to any disclaimer, the term of this patent is extended or adjusted under 35 U.S.C. 154(b) by 0 days.

(21) Appl. No.: 09/903,192

(22) Filed: Jul. 11, 2001

(51) Int. Cl.[7] ..... H01H 43/10; H01H 7/08

(52) U.S. Cl. ..... 200/38 R; 200/38 A; 200/11 R; 200/566

(58) Field of Search ..... 200/38 R, 38 A, 200/38 D, 11 R, 566, 336, 318

(56) References Cited

U.S. PATENT DOCUMENTS 3,728,511 A * 4/1973 George et al. ..... 200/168 B
4,716,263 A * 12/1987 Havel ..... 200/11 R
5,086,200 A * 2/1992 Kline et al. ..... 200/571
5,921,381 A * 7/1999 Von Arx ..... 200/345
5,954,192 A * 9/1999 Iitsuka ..... 200/336
5,990,426 A 11/1999 Amonett
6,288,351 B1 * 9/2001 Bruntz ..... 200/336

* cited by examiner

*Primary Examiner*—Elvin Enad
*Assistant Examiner*—Kyung S. Lee
(74) *Attorney, Agent, or Firm*—Cook, Alex, McFarron, Manzo, Cummings & Mehler, Ltd.

(57) ABSTRACT

A knob for installation on the end of a timer control shaft having a pair of flexible fingers. The knob includes a core, a hub in the core and a shaft receiving passage formed in the core. A shaft entrance of generally circular transverse cross section is formed on the timer side of the knob. A pair of arcuate ribs are formed in the passage inwardly of the entrance. A pair of diametrically located gaps are formed between the arcuate ribs. Shaft finger receiving channels are formed in the walls of the passage at the gaps with each channel having a base wall which tapers radially inwardly in an axial direction from the passage entrance to a constriction and then tapers radially outwardly in a farther axial direction away from the entrance. Corner projections are located at the constriction and extend axially of the constriction toward and away from the channel entrance. The shaft receiving passage may extend through the core or it may be a blind passage.

7 Claims, 5 Drawing Sheets

TIMER KNOB

BACKGROUND AND SUMMARY OF THE INVENTION

This invention is directed to a knob for installation on the end of a control shaft of a cam operated timer of the type used in household appliances and shown in U.S. Pat. No. 5,990,426. Such a knob permits rotation of the control shaft bi-directionally and movement of the shaft axially towards and away from the timer without dislodging the knob from the shaft. Due to the shape of the shaft passage entrance in the prior knob, it was necessary to manually rotate the knob to orient it relative to the shaft before assembly of the knob on the shaft of the timer.

The method of making the previous knob by injection molding required the use of a pair of molding tools such as core pins, one insertable from the shaft side and one insertable from the front side of the knob.

The knob of this invention is simpler to mold than the prior knob, reduces the amount of plastic necessary to mold the knob and facilitates the installation of the knob on to the shaft of the timer.

An object of this invention is a knob for a control shaft of a cam-operated timer than can be injection molded using a single collapsible stem hole core pin insertable from the shaft facing side of the knob.

Another object of this invention is a knob for a control shaft of a timer which knob can be assembled on the control shaft of the timer by rotation of the knob without requiring visual or tactile rotational alignment of the knob and the control shaft.

Still another object of this invention is a knob which resists accidental rotation relative to its shaft during its installation on the shaft.

Yet another object of this invention is a knob in which the quantity of plastic necessary to mold the knob is reduced relative to the prior knob without diminishing the strength of its core to a level it would not function.

An additional object of this invention is a knob for a control shaft of a cam-operated timer which can be formed with a blind shaft passage.

A further object of this invention is a knob having a blind passage which receives a control shaft with spring fingers which does not interfere with locking and unlocking movement of the spring fingers.

A still further object of this invention is a knob having a blind passage which receives a control shaft with spring fingers which securely holds the spring fingers in engagement with a shaft locking pin clear of the bottom wall of the blind passage.

Yet a further object of this invention is a knob having a blind passage for a control shaft with spring fingers secured by a locking pin equipped with a depressible cover to release the locking pin.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENTS

Figure 2:
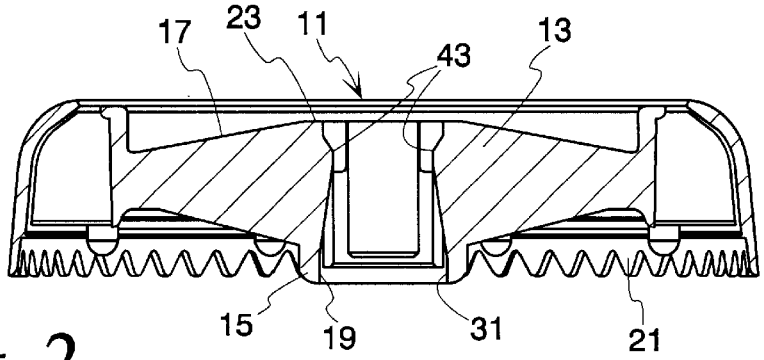
FIG. 2 is a cross sectional view taken along line 2—2 of FIG. 1.
Figure 1:
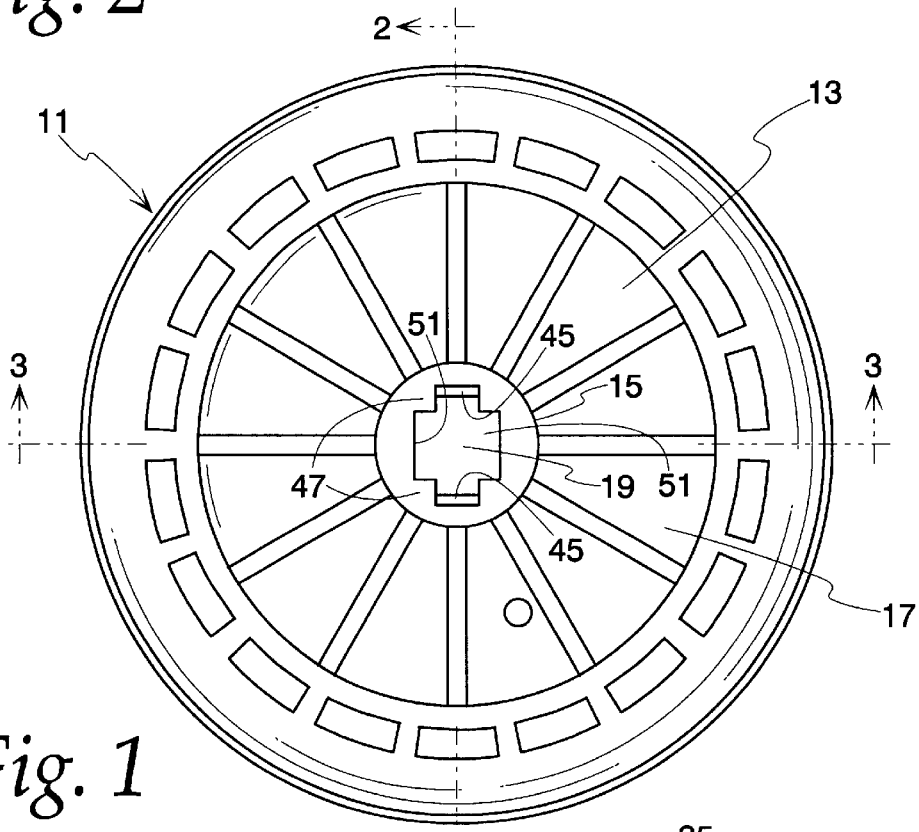
FIG. 1 is an enlarged top plan view of a first embodiment of a knob of this invention.
Figure 3:
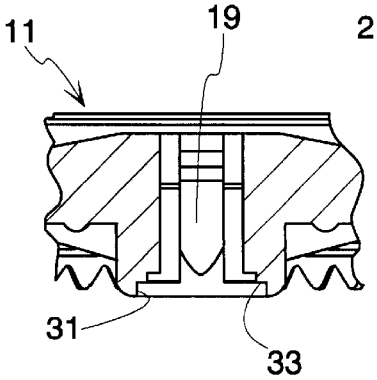
FIG. 3 is a partial cross sectional view taken along line 3—3 of FIG. 1.
Figure 4:
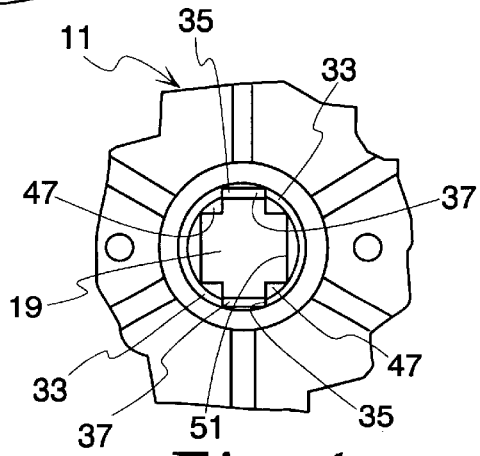
FIG. 4 is a partial bottom plan view of the knob of FIG. 1.

FIGS. 1–10 of the drawings show a first embodiment of the invention embodied in a knob 11 which may be injection molded of a suitable plastic. The knob includes a core 13 and a hub 15 integrally formed therewith. A well or socket 17 may be formed at the end of the knob which faces the user and which is usually referred to as the front face of the knob. A closure cover (not shown) may be attached to the front face of the knob to enclose the well 17. A shaft receiving passage 19 is formed in the hub 15 of the core. This passage extends from the side 21 of the knob which faces a timer (not shown), usually called the rear face, to the front face 23 of the knob. The shaft receiving passage 19 is formed to receive the control shaft 25 of a timer which shaft is conventionally formed with shaft spring fingers 27 and a shaft locking pin 29. The shaft spring fingers enable the control shaft 25 to be connected to the knob 11 so that the knob can rotate the shaft bi-directionally as well as towards and away from the timer without dislodging the knob from the shaft once the knob has been fully seated on the shaft.

Figure 5:
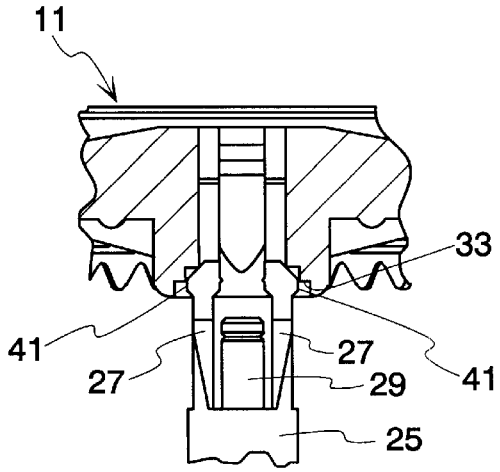
FIG. 5 is a partial view showing the fingers of a control shaft being inserted into the shaft passage entrance of the knob.

A circular control shaft entrance 31 is formed in the passage 19 on the rear side 21 of the knob. This entrance is circular in shape to permit the control shaft fingers 27 to be inserted in the entrance without a need for rotational orientation of the shaft relative to the knob. As shown in FIG. 5 of the drawings, the shaft spring fingers 27 will engage radially extending arcuate ribs 33 or the radial inner edges thereof formed at the shaft entrance 31 of the passage 19 to prevent farther inward insertion of the shaft spring fingers into the shaft receiving passage 19 until the shaft spring fingers are rotated to a position where they align with gaps 35 formed in the arcuate ribs. Shaft spring arm receiving channels 37 are formed in the shaft receiving passage 19 axially inwardly of the ribs 33 and in alignment with the gaps 35. When the shaft spring fingers 27 are aligned with the gaps 35, which can be accomplished simply by rotation of the knob relative to the shaft, the spring fingers will enter the channels 37.

Figure 6:
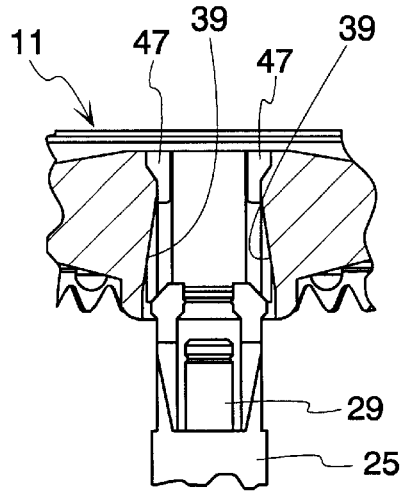
FIG. 6 is a partial view of the control shaft and the knob with the view rotated 90° relative to the view of FIG. 5 and the shaft fingers initially seated in the finger channels of the shaft passage in the knob.
Figure 7:
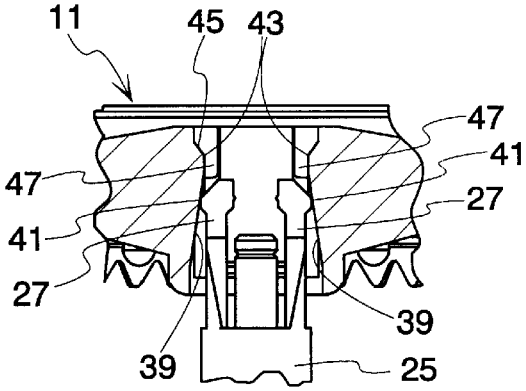
FIG. 7 is a view similar to FIG. 6 showing the fingers of the control shaft being forced together by engagement with the base walls of the finger channels as the shaft is continuing to be inserted into the shaft passage.
Figure 8:
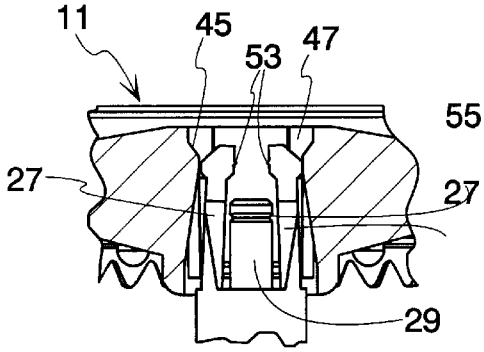
FIG. 8 is a view similar to FIG. 7 showing the stops in the shaft passage which prevent rotation of the fingers as they are being wedged together by the base walls of the finger channels as the shaft is moved farther into the shaft passage of the knob.
Figure 9:
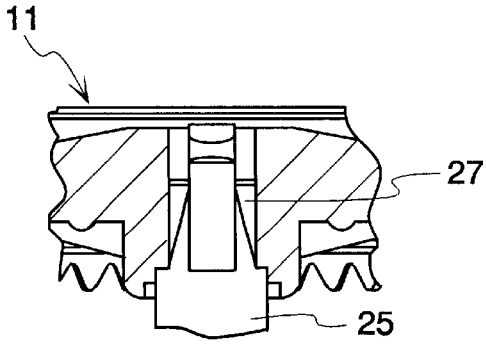
FIG. 9 is a view similar to FIG. 8 but rotated 90° therefrom and showing the shaft locking pin of the shaft partially inserted between the fingers of the shaft.

Upon entrance of the spring fingers 27 into the channels 37 as shown in FIG. 6 of the drawings, the spring fingers, specifically the barbs 41 formed on the outwardly facing portions of the spring fingers, will engage base walls 39 of the channels 37. The base walls 39 of the channels 37 taper radially inwardly in an axial direction away from the shaft entrance 31. The channel base walls 39 merge towards each other until they reach a constriction 43 in the shaft receiving passage 19 at which point the base wall portions 45 then flare radially outwardly in an axial direction away from passage shaft entrance 31 to the passage 19. Corner projections 47, shown most clearly in FIGS. 1, 4, 6, 7 and 8 of the drawings, overlap the constrictions 43 of the shaft receiving passage 19 in an axial direction of the passage away from the entrance. The corner projections are formed in the passage 19 by creating, in effect, what are cutouts 51 of rectangular transverse cross section in the core 13. Elimination of this plastic from the core not only reduced the amount of plastic in the core but permits the use of a molding tool with a greater transverse cross section thereby strengthening the molding tool.

Figure 10:
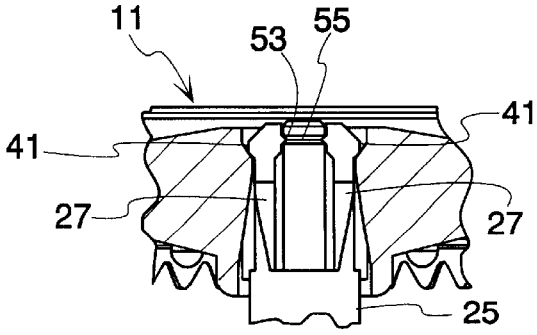
FIG. 10 is a view similar to FIG. 9 but rotated 90° therefrom showing the fingers of the control shaft in engagement with the shaft locking pin to prevent movement of the fingers towards each other.

The structure of the knob of this invention facilitates seating and locking of the spring shaft fingers 27 on the control shaft 25 of the conventional timer (previously mentioned). The structure of this passage cooperates with the radial extending barbs 41 which are formed on the spring fingers and radially inwardly facing ribs 53 which are formed on the spring fingers to enable them to seat in a groove 55 located at the distal end of the shaft locking pin 29. As shown most clearly in FIG. 7 of the drawings, inwardly movement of the shaft spring fingers 27 positions their barbs 41 in engagement with the radially inwardly inclined base walls 39 of the shaft receiving channels 37. Axial movement of the shaft 25 engages the shaft spring fingers 27 with the inclined base walls 39 and forces the shaft spring fingers radially toward each other. As the shaft spring fingers reach the constriction 43 of the shaft receiving passage 19, they are prevented from rotation by the corner projections 47 which axially overlap the channel base walls 39 and the passage constriction 43. As the shaft spring fingers are bottomed in the shaft passage 19, their barbs 41 extend radially outwardly against the outwardly flaring base wall portions 45 of the channels 37 as shown in FIG. 10. At this point in the installation of the knob, the shaft locking pin 29 is moved fully into the passage so that the ribs 53 on the spring fingers seat in the locking pin groove 55 preventing axial movement of the shaft and its spring fingers either inwardly or outwardly. Now the knob 11 can be manipulated to move the control shaft of the timer both circumferentially and axially.

Figure 11:
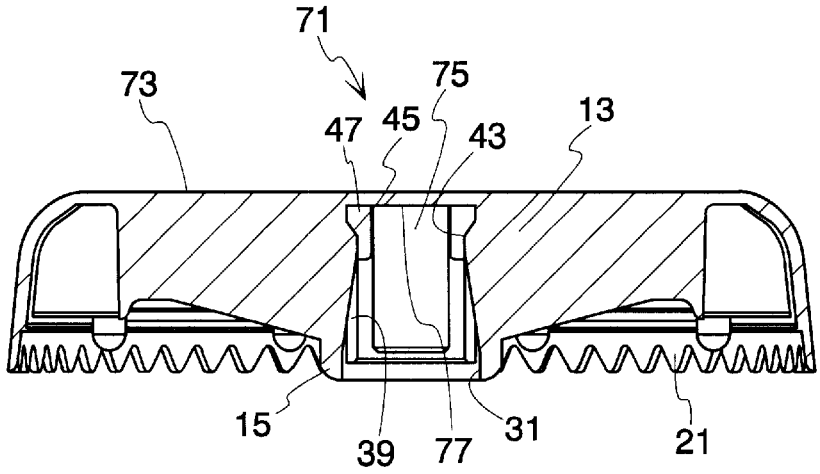
FIG. 11 is a view similar to FIG. 2 but showing a knob with a blind shaft receiving passage.
Figure 12:
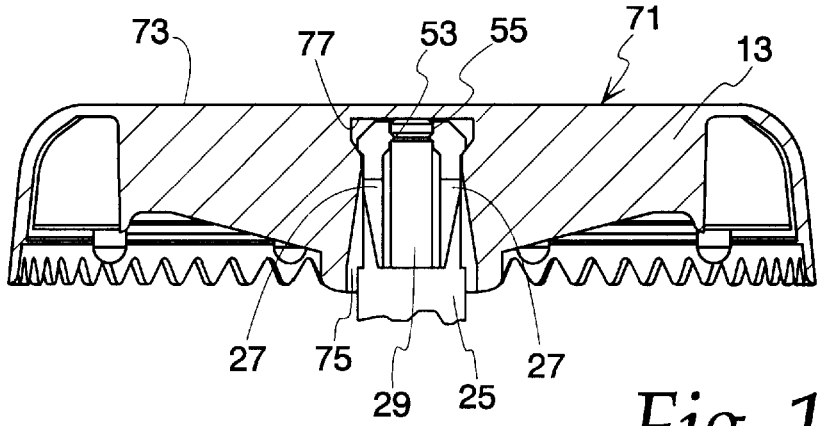
FIG. 12 is a view similar to FIG. 10 showing the fingers of the control shaft in engagement with the shaft locking pin.

FIGS. 11 and 12 of the drawings show a second embodiment of the invention incorporated in a knob 71 of the same general construction as the knob 11 heretofore described. Structural features of knob 71 which are the same as those of knob 11 will be identified by the same numbers but generally will not be discussed in detail in this description of knob 71 except where these elements affect or are affected by the modified features of knob 71. Knob 71 includes a core 13 and a hub 15 formed integrally therewith. A flat surface 73 is formed at the end of the knob which faces the user and which is usually referred to as the front face of the knob. A shaft receiving blind hole 75 is formed in the hub 15 of the core. The entrance to this passage or blind hole is located on the side 21 of the knob which faces a timer (not shown), usually called the rear face and continues to a bottom wall 77 in the hole 75. The shaft receiving blind hole 75 is formed to receive the control shaft 25 of a timer which shaft is conventionally formed with shaft spring fingers 27 and a shaft locking pin 29 as previously described.

A circular control shaft entrance 31 is formed in the passage 75 and is circular in shape for reasons previously described in connection with the first embodiment of this invention. Arcuate ribs 33 are formed at the shaft entrance 31 of the passage 75 and gaps 35 are formed in the arcuate ribs and are diametrically located relative to each other. Shaft spring arm receiving channels 37 are formed in the shaft receiving passage 75 axially inwardly of the ribs 33 and in alignment with the gaps 35. The shaft spring arm receiving channels 37 have base walls 39 which taper radially inwardly in an axial direction away from the shaft entrance 31. The channel base walls merge towards each other until they reach a constriction 43 in the shaft receiving passage 19 at which point the base wall portions 45 then flare radially outwardly in an axial direction from the passage shaft entrance 31 to the passage 75. Corner projections 47 overlap the constriction 43 of the shaft receiving passage 75 in an axial direction of the passage away from the entrance and towards the end wall 77 of the passage 75.

FIG. 12 of the drawings shows the control shaft 25 of the timer and its shaft spring fingers 27 bottomed in the shaft receiving passage 75 in contact or just short of contact with the bottom wall 77 of the passage. At this point, the barbs 41 of the shaft spring fingers 27 extend radially outwardly against the outwardly flaring base wall portions 45 of the channels 37. The shaft locking pin 29 is moved fully into the passage so that the ribs 53 on the spring fingers seat in the locking pin groove 55 preventing axial movement of the shaft and its spring fingers either inwardly or outwardly. Now the knob 71 can be manipulated to move the control shaft of the timer both circumferentially and axially.

Figure 13:
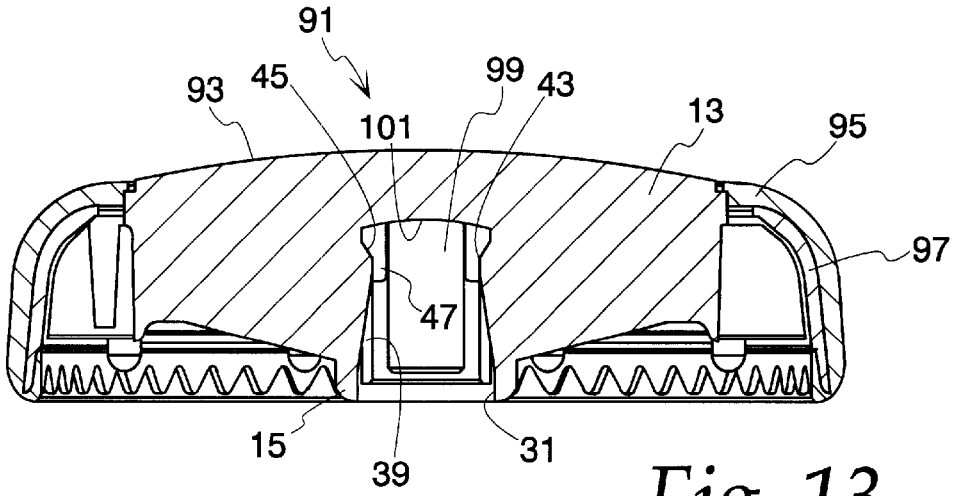
FIG. 13 shows another embodiment of the invention incorporated in a knob having a blind hole shaft passage with a concave bottom wall.
Figure 14:
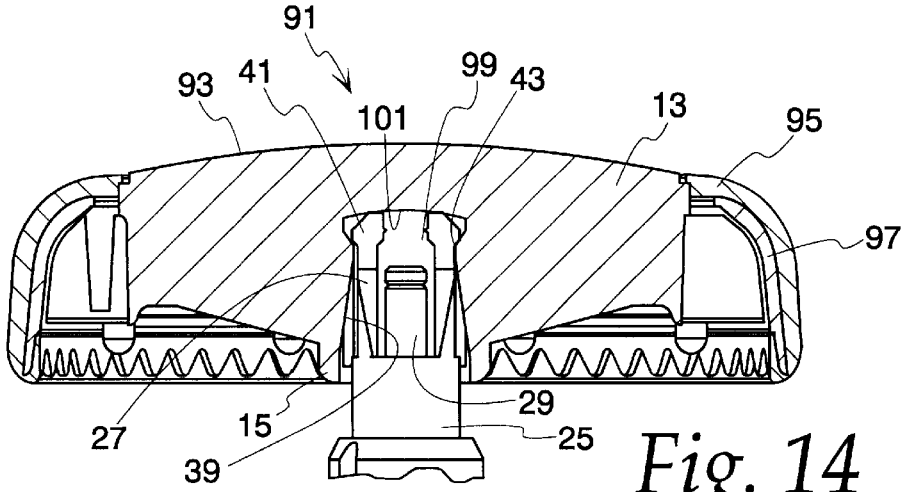
FIG. 14 shows a timer control shaft spring fingers bottomed in the shaft passage of FIG. 13.

FIGS. 13 and 14 of the drawings show a third embodiment of the invention incorporated in a knob 91 of the same general construction as the knob 11 heretofore described. Structural features of the knob 91 which are the same as those of knob 11 will be identified by the same numbers but generally will not be discussed in detail in this description except where these structural features affect or are affected by the modified features of knob 91. In common with knobs 11 and 71 previously described, knob 91 includes a core 13 and a hub 15 formed integrally therewith. A curved or crowned surface 93 is formed at the end of the knob which faces the user and which is usually referred to as the front face of the knob. An outer layer of plastic 95 is formed over a skirt portion 97 of the core 13. The plastic 95 is softer than the plastic forming the core 13 for ease of gripping of the knob by a user.

A shaft receiving blind hole 99 is formed in the hub 15 of the core. The entrance to this passage or blind hole is located on the side of the knob which faces the timer (not shown), usually referred to as the rear face. The blind hole terminates in a concave bottom wall 101. The shaft receiving blind hole 99 is formed to receive the control shaft 25 of a timer, which shaft is conventionally formed with shaft spring fingers 27 and a shaft locking pin 29 of the type previously described.

A circular control shaft entrance 31 having accurate ribs 33 with gaps 35 is formed in the shaft passage 99. Shaft spring arm receiving channels 37 with radially inwardly tapering base walls 39 are also formed in the passage 99. Base wall portions 45 flare radially outwardly in a direction axially inwardly of the constriction 43 in the passage 99. Corner projections 47 overlap the constriction 43 of the passage 99.

FIG. 14 of the drawings shows the control shaft 25 of the timer and its shaft spring fingers 27 bottomed in the shaft receiving passage 99 in contact with or just short of contact with the concave bottom wall 101 of the passage. The locking pin 29 of the control shaft 25 is retracted short of its spring fingers locking position. The barbs 41 of the spring shaft fingers 27 extend radially outwardly against the outwardly flaring base wall portions 45 of the channels 37. The distal ends of the shaft spring fingers 27 engage or are close to engagement with the concave bottom wall 101 of the passage 99. The radius of curvature of the concave wall 101 is formed to be greater than the radius of movement of the shaft spring fingers 27 so that these fingers can be rotated towards and away from the locking pin 29 of the control shaft without being restricted or obstructed in movement by engagement with the concave bottom wall 101.

Figure 15:
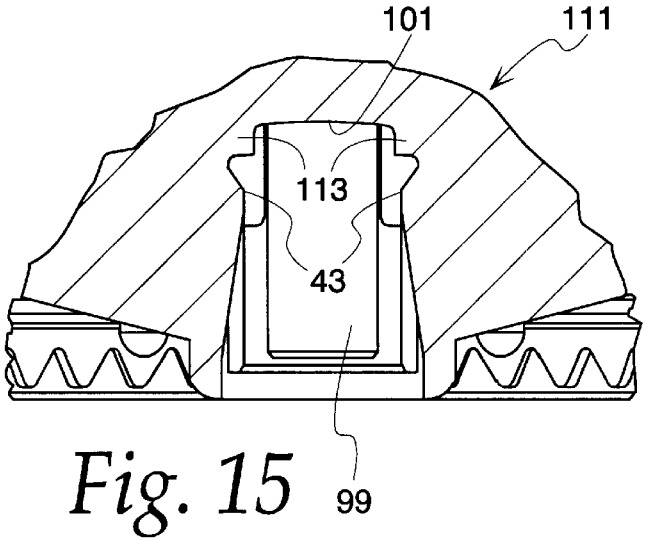
FIG. 15 is a partial view of yet another embodiment of the invention incorporated in a knob.
Figure 16:
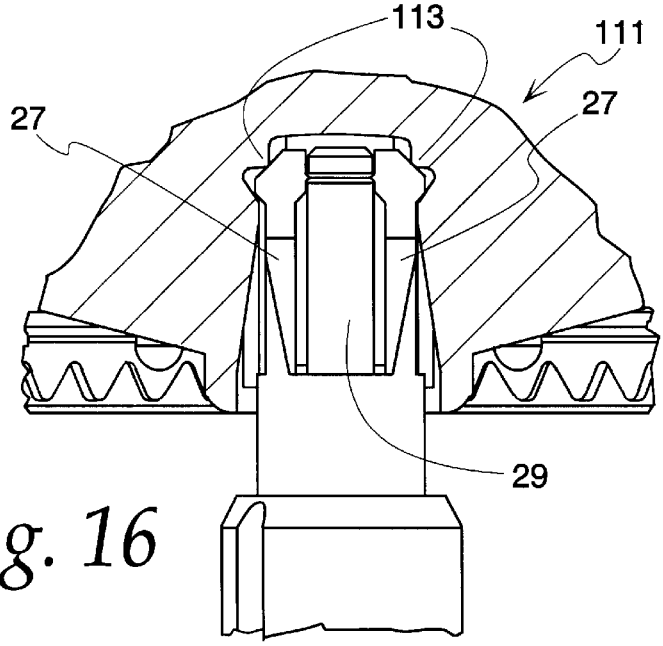
FIG. 16 is a partial view of a timer control shaft spring fingers locked in position in the shaft passage of FIG. 15.

FIGS. 15 and 16 show a fourth embodiment of the invention incorporated in a knob 111. Knob 111 is similar in construction to knob 91 differing in that knob 111 includes protrusions 113 located in the blind passage 99 between the concave bottom wall 101 and the constriction 43 in the blind passage. As shown in FIG. 16, the sloped end walls of the shaft spring fingers 27 engage the protrusions 113 when the fingers are bottomed in the blind passage 99 and the locking pin 29 of the control shaft 25 is in its fully extended position. This construction locks the spring fingers against rotation and axial movement without requiring the spring fingers or the control shaft 25 to engage the bottom wall 101 of the blind passage 99.

Figure 17:
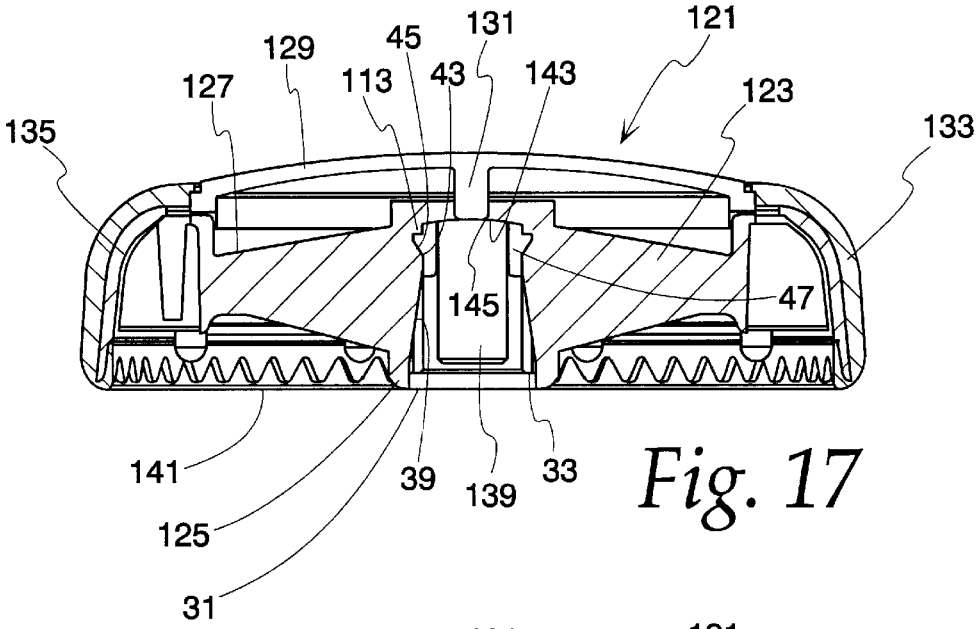
FIG. 17 is a cross-sectional view of still another embodiment of the invention incorporated in a knob having a flexible, resilient cap which can be depressed to release the locking pin of a timer control shaft.
Figure 18:
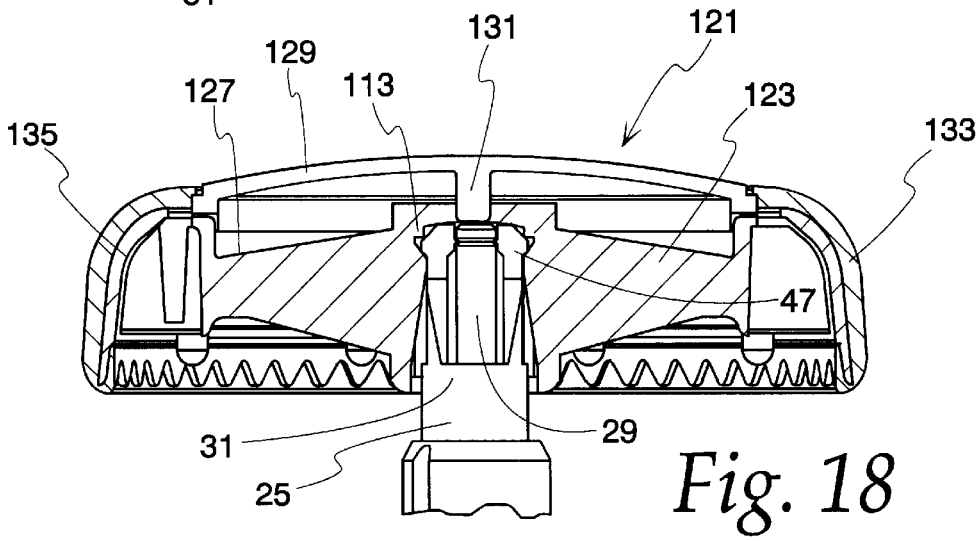
FIG. 18 is a cross-section view of the knob of FIG. 17 showing the timer control shaft spring fingers locked in position in the shaft passage.
Figure 19:
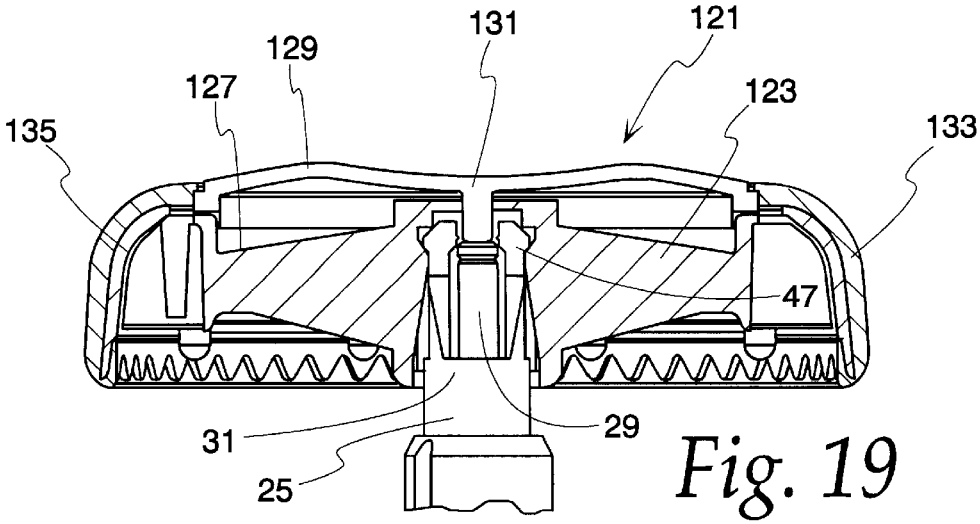
FIG. 19 is a view similar to FIG. 18 showing the knob cap in a depressed condition in which the locking pin is disengaged from the timer control shaft spring fingers.

FIGS. 17, 18 and 19 show a fifth embodiment of the invention incorporated in a knob 121 which may be injection molded of a suitable plastic. The knob includes a core 123 and a hub 125 formed integrally therewith. A well or socket 127 may be formed at the end of the knob which faces the user and which is usually referred to as the front face of the knob. A convex shaped outwardly bulging, flexible, resilient cap 129 is molded of a suitable plastic and has an inwardly extending post 131. Whereas, the post 131 is shown as formed as a part of the resilient cap 129, in the alternative the post 131 could be formed as a part of or attached to the shaft locking pin 29. The cap 129 encloses the well 127 with the periphery of the cap supported on the core 123 radially inwardly of the core skirt 135. A thin layer 133 of a soft plastic is molded over the periphery of the cap and the core skirt 135 to secure the cap to the knob 121.

A shaft receiving blind hole 137 is formed in the hub 125 of the core 123. The entrance to this blind hole or passage is located on the side 141 of the knob which faces the timer (not shown), usually referred to as the rear face of the knob. The shaft receiving blind hole 139 terminates in a somewhat concave bottom wall 143. The blind hole or passage is formed to received the control shaft 25 of a timer, which shaft is conventionally formed with shaft spring fingers 27 and a shaft locking pin 29.

In common with the previously described embodiments of the invention, the knob 121 includes a circular control shaft entrance 31, accurate ribs 33 with gaps, shaft spring arm receiving channels with radially inwardly tapering base walls 39 and outwardly flaring base wall portions 45 located axially inwardly of a constriction 43. Also, corner projections 47 overlap the constriction and protrusions 113 are located between the bottom wall 143 and the constriction 43. An passage 145 extends through the bottom wall 143 of the blind passage 139 to receive the inwardly extending post 131 of the flexible cap 129.

When the shaft locking pin 29 is located in its fully extended position shown in FIG. 18 of the drawings, in which it secures the shaft spring fingers 27 against inwardly and outwardly movement, the pin 29 is contacting the post 131 of the cap 129. The cap 129 is bowed outwardly with its post 131 extending into the passage 145 and through the bottom wall 143 of the passage 145. To release the locking pin 29, the convex center of the cap is depressed as shown in FIG. 19 thereby moving the post 131 inwardly and forcing the pin 29 out of contact with shaft spring fingers 27. The locking pin 29 would be released in the same manner if the post 131 were formed as part of or attached to the locking pin 29 in the alternative embodiment previously discussed.

What is claimed is:

1. A knob for installation on the distal end of a shaft, said distal end including a pair of oppositely located flexible fingers, said knob including:

a core, a hub formed with said core, a shaft receiving passage extending axially into said hub, said passage having a shaft entrance at one end thereof, said shaft entrance having a circular transverse cross section, a pair of radially inwardly extending arcuate ribs formed in said passage at a location axially inwardly of said shaft entrance, a pair of diametrically positioned gaps formed between said arcuate ribs, and shaft finger receiving channels formed in said passage at said gaps with said channels having base walls tapering radially inwardly in an axial direction from said entrance to a constriction and then tapering radially outwardly in a farther axial direction away from said entrance.

2. The knob of claim 1 including:

corner projections located at said constriction of said channel base walls and extending axially of said constriction toward and away from said channel entrance;

said corner projections engaging said flexible fingers to prevent rotation of said fingers and said shaft when said fingers are located at said constriction.

3. The knob of claim 2 in which said corner projections are defined by said finger receiving channels and by oppositely located cut away portions of said core.

4. The knob of claim 1 in which said hub has a front face and said shaft passage terminates short of said front face.

5. The knob of claim 4 in which said shaft passage terminates in a concave wall.

6. The knob of claim 5 in which said concave wall has a radius of curvature which is smaller than the radius of movement of said flexible fingers.

7. A knob for installation on the distal end of a shaft, said distal end including a pair of oppositely located distal fingers which move in an arc towards and away from each other and an axially moveable locking pin which can be moved into and out of engagement with said fingers, said knob including;

a core, a hub formed with said core, a shaft receiving passage extending axially into said hub and terminating in an end wall, a socket formed in said core opposite to said shaft receiving passage, a hole formed in said passage end wall connecting said passage and said socket, a deformable cap covering said socket and secured to said core and, a post extending between said cap and said locking pin and projecting through said socket and into said hole to engage said locking pin, said post being moveable on defamation of said cap to move said locking pin away from engagement with said fingers.

* * * * *